US007104018B2

(12) United States Patent
Romes et al.

(10) Patent No.: US 7,104,018 B2
(45) Date of Patent: Sep. 12, 2006

(54) SYSTEM FOR INSULATING VERTICAL WALL

(75) Inventors: Gary E. Romes, Cincinnati, OH (US); Joseph T. Church, Collierville, TN (US); Matthew D Mattmuller, Aurora, OH (US)

(73) Assignee: Guardian Fiberglass, Inc., Auburn Hills, MI (US)

( * ) Notice: Subject to any disclaimer, the term of this patent is extended or adjusted under 35 U.S.C. 154(b) by 0 days.

(21) Appl. No.: 10/642,514

(22) Filed: Aug. 18, 2003

(65) Prior Publication Data

US 2005/0055971 A1 Mar. 17, 2005

(51) Int. Cl.
*E04B 1/74* (2006.01)

(52) U.S. Cl. ..... 52/405.1; 52/506.05; 52/506.01; 52/407.4; 52/743

(58) Field of Classification Search ..... 52/309.7, 52/506.05, 506.06, 508, 506.01, 405.1, 309.9, 52/407.3, 407.4, 489.1, 404.2, 404.1, 743
See application file for complete search history.

(56) References Cited

U.S. PATENT DOCUMENTS

| | | | | | |
|---|---|---|---|---|---|
| 1,912,972 | A | | 6/1933 | Coca | |
| 2,172,048 | A | * | 9/1939 | Johnson | 52/407.3 |
| 2,335,220 | A | * | 11/1943 | Edwards | 428/104 |
| 3,181,662 | A | | 5/1965 | Maertzig, Jr. | |
| 3,222,018 | A | | 12/1965 | Masters | |
| 3,248,838 | A | * | 5/1966 | Stark | 52/489.2 |
| 3,427,775 | A | * | 2/1969 | Bachrich | 52/402 |
| 3,525,189 | A | * | 8/1970 | Nelsson | 52/378 |
| 4,096,681 | A | | 6/1978 | Netterstedt et al. | |
| 4,107,887 | A | * | 8/1978 | Wendt | 52/105 |
| 4,286,420 | A | * | 9/1981 | Pharmakidis | 52/404.1 |
| 4,288,951 | A | * | 9/1981 | Carlson et al. | 52/94 |
| 4,346,543 | A | | 8/1982 | Wilson et al. | |
| 4,731,972 | A | | 3/1988 | Anderson | |
| 4,774,791 | A | * | 10/1988 | Kafarowski | 52/235 |
| 5,299,403 | A | | 4/1994 | Fentz | |
| 5,365,716 | A | * | 11/1994 | Munson | 52/742.13 |
| 5,606,833 | A | | 3/1997 | Andersson | |
| 5,701,711 | A | * | 12/1997 | Bases et al. | 52/506.03 |
| 5,755,070 | A | * | 5/1998 | Hohmann | 52/489.1 |
| 5,758,464 | A | | 6/1998 | Hatton | |
| 6,158,915 | A | | 12/2000 | Kise | |
| 6,202,377 | B1 | | 3/2001 | Krieger | |
| 6,247,288 | B1 | | 6/2001 | Harkins | |
| 6,308,489 | B1 | | 10/2001 | Romes | |

(Continued)

FOREIGN PATENT DOCUMENTS

| | | |
|---|---|---|
| EP | 0 095 407 | 11/1983 |

(Continued)

*Primary Examiner*—Carl D. Friedman
*Assistant Examiner*—Basil Katcheves
(74) *Attorney, Agent, or Firm*—Nixon & Vanderhye P.C.

(57) ABSTRACT

A system and method are provided for insulating a vertically extending wall (e.g., concrete wall). First and second supports are first attached to the vertical wall at respective first and second vertically spaced locations (e.g., proximate the top and bottom of the wall). After the supports have been attached to the wall, a blanket(s) of rolled fiberglass insulation (e.g., metal building insulation) is attached to the wall between the first and second supports. Then, a flexible sheet of vapor retarder is attached to protruding portions of the first and second supports so as to cover the blanket(s) of fiberglass insulation thereby causing the blanket of fiberglass insulation to be partially or fully hidden from view and retained in the cavity defined between the vertical wall and the vapor retarder.

18 Claims, 6 Drawing Sheets

U.S. PATENT DOCUMENTS

| | | | | |
|---|---|---|---|---|
| 6,341,461 | B1 | 1/2002 | Crowley et al. | |
| 6,385,935 | B1 | 5/2002 | Lippy | |
| 6,393,797 | B1 | 5/2002 | Romes | |
| 6,557,313 | B1 * | 5/2003 | Alderman | 52/407.3 |
| 6,595,455 | B1 | 7/2003 | Romes | |
| 2003/0070379 | A1 | 4/2003 | Worley | |

FOREIGN PATENT DOCUMENTS

| | | |
|---|---|---|
| JP | 4-327630 | 11/1992 |
| JP | 6-158816 | 6/1994 |

* cited by examiner

SYSTEM FOR INSULATING VERTICAL WALL

This application relates to a system and method for insulating a vertically extending wall such as a concrete vertical wall. In certain example embodiments, the vertical wall is insulated by at least one layer of fiberglass blanket insulation which is covered by at least one layer of a flexible vapor retarding sheet.

BACKGROUND OF THE INVENTION

It is known in the art to insulate vertically extending walls such as vertical walls made of poured concrete. Typically, such walls are insulated by fastening an array of small foam boards to the wall. Unfortunately, this technique for insulating vertical walls is very costly (the small foam boards are expensive), and results in many aesthetically displeasing seams between boards being formed on the interior side of the insulated wall. Additionally, since the foam boards are manufactured at sites distant from the wall to be insulated, they must be transported in board form to the installation site.

Accordingly, it will be appreciated that there exists a need in the art for a system and/or method for insulating vertical walls in a more efficient and/or aesthetically pleasing manner.

BRIEF SUMMARY OF EXAMPLE EMBODIMENTS

In certain embodiments of this invention, vertical walls (e.g., concrete vertical walls) may be insulated in an efficient manner using large sheets of inexpensive materials such as rolled fiberglass blanket insulation and/or rolled vapor retarder material. The use of large sheets of inexpensive material allows fewer seams to be present on the interior side of the final insulated wall, and also allows costs to be minimized.

In certain example embodiments of this invention, first and second supports are attached to the vertical wall at respective first and second vertically spaced locations (e.g., proximate the top and bottom of the wall). The supports may be made of metal, or any other suitable material such as plastic or the like. After the supports have been attached to the wall, at least one blanket of rolled fiberglass insulation (e.g., metal building insulation) is attached to the wall between the first and second supports. The blanket of fiberglass insulation may be attached to the wall via one or more stick pins, nails, adhesive, and/or any other suitable type(s) of fastener. After the blanket of fiberglass insulation has been attached to the wall, a flexible sheet of vapor retarder (e.g., polymer inclusive vapor retarder) is attached to protruding portions of the first and second supports so as to cover the blanket of fiberglass insulation thereby causing the blanket of fiberglass insulation to be partially or fully hidden from view and retained in the cavity defined between the vertical wall and the vapor retarder. This process may be repeated, in full or in part, one or more times for adjacent portions of the vertical wall until the entire wall has been insulated.

In certain example embodiments of this invention, there is provided a method of insulating a vertically extending concrete wall, the method comprising: attaching first and second supports to the vertically extending concrete wall at respective first and second vertically spaced apart locations, each of said first and second supports including a protruding portion; after attaching the first and second supports to the vertically extending concrete wall, attaching at least one blanket of insulation comprising fiberglass to the wall between the first and second supports; and subsequent to attaching the blanket of insulation to the wall between the first and second supports, attaching a flexible vapor retarder sheet to the protruding portion of each of the first and second supports so that the flexible vapor retarder sheet covers the blanket of insulation which is located in a cavity defined at least partially between the wall and the flexible vapor retarder sheet.

In other example embodiments of this invention, there is provided a vertically insulated wall structure comprising: a vertically extending concrete wall; first and second supports attached to the vertically extending concrete wall at respective first and second vertically spaced apart locations, each of said first and second supports including a protruding portion; a blanket of insulation comprising fiberglass attached to the wall between the first and second supports; and a flexible vapor retarder sheet attached to the protruding portion of each of the first and second supports so that the flexible vapor retarder sheet covers the blanket of insulation which is located in a cavity defined at least partially between the wall and the flexible vapor retarder sheet.

DETAILED DESCRIPTION OF THE INVENTION

Figure 1:
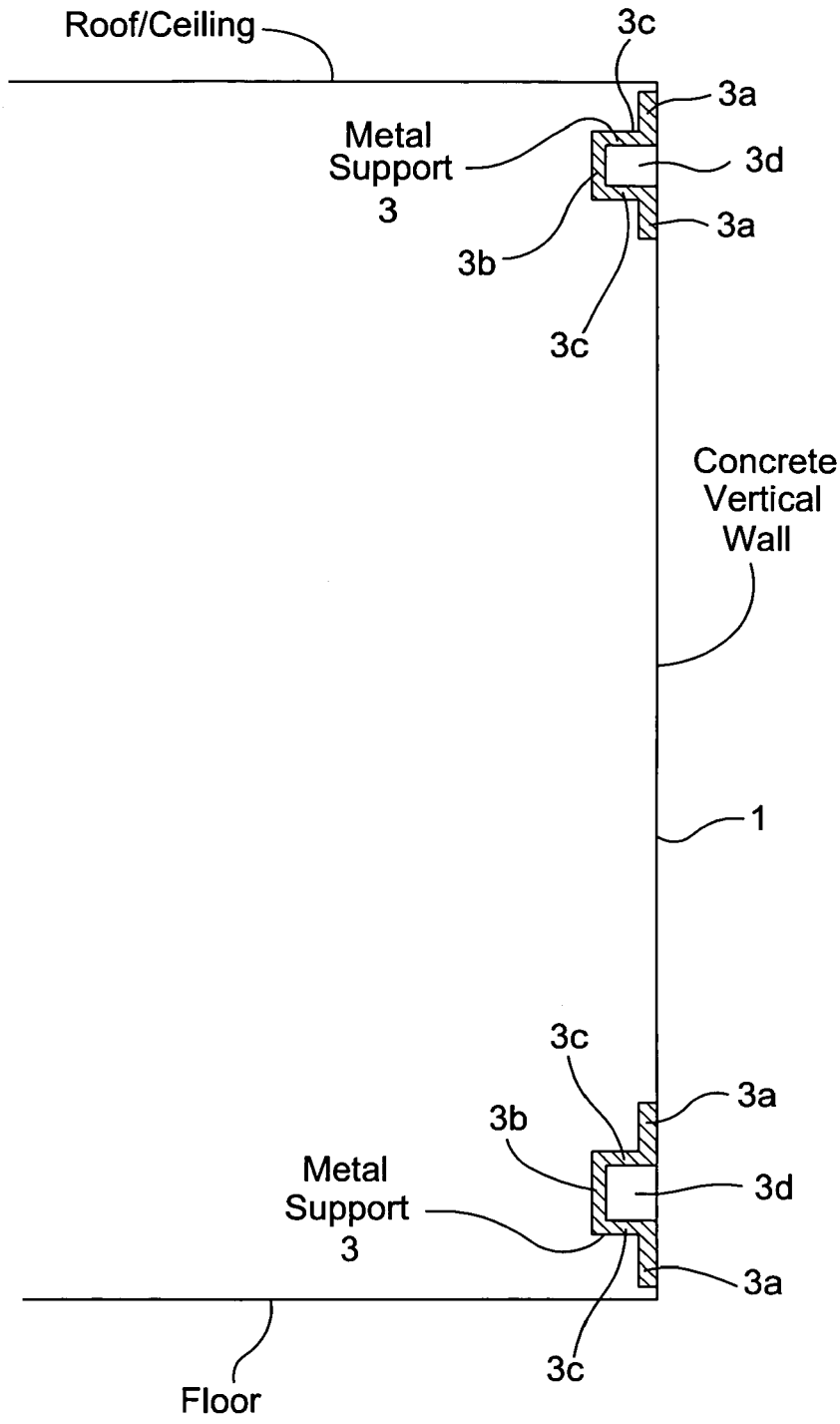
FIG. 1 is a cross sectional view of a step undertaken in insulating a vertically extending wall according to an example embodiment of this invention.

Referring now to the figures in which like reference numerals indicate like parts throughout the several views.

Certain example embodiments of this invention relate to insulating vertically extending walls such as concrete walls (or walls of other suitable material) often used in commercial buildings such as warehouses and the like. In certain example embodiments, in order to insulate such a wall, first and second supports are attached to the vertical wall at respective first and second vertically spaced locations. The first and second supports may be attached proximate the top and bottom of the wall in certain example instances. However, in other example embodiments, they may be attached to the wall at other locations. For example, if it desired to insulate only a top portion of the wall, the first support can be attached to a top portion of the wall and the second support can be attached to a middle portion of the wall instead of the bottom of the wall so that the area to be insulated is located between the supports. The supports may be made of metal, or any other suitable material such as plastic or the like.

After the supports have been attached to the wall, at least one blanket of rolled fiberglass insulation (e.g., metal building insulation) is attached to the wall between the first and second supports. The blanket(s) of fiberglass insulation may be attached to the wall via one or more stick pins, nails, adhesive, and/or any other suitable type(s) of fastener (or otherwise positioned immediately adjacent the wall). After the blanket(s) of fiberglass insulation has been attached to the wall, a flexible opaque sheet of vapor retarder is attached to protruding portions of the first and second supports so as to cover at least one of the blanket(s) of fiberglass insulation thereby causing the blanket of fiberglass insulation to be partially or fully hidden from view and retained in the cavity defined between the vertical wall and the vapor retarder. The vapor retarder functions to: (a) retard vapors such as moisture, (b) retain the insulation blanket(s) in the cavity between the vapor retarder and wall, and (c) provide a smooth finish with a minimal number of seams between adjacent vapor retarder sheets.

This process may be repeated for adjacent portions of the wall until the entire wall has been insulated. Alternatively, the supports and a plurality of adjacent blankets of fiberglass insulation may be attached to the entire wall, and thereafter a plurality of strips of the vapor retarder material may be attached to the supports in order to cover the insulation thereby completing the insulated wall structure. In any event, adjacent overlapping sheets of vapor retarder on the wall may be adhered to one another via double-sided tape or the like in certain example embodiments of this invention.

The use of large sheets of inexpensive material such as blanket fiberglass insulation and vapor retarder sheet(s) advantageously allows fewer seams to be present on the interior side of the final insulated wall and allows costs to be minimized.

Figure 4:
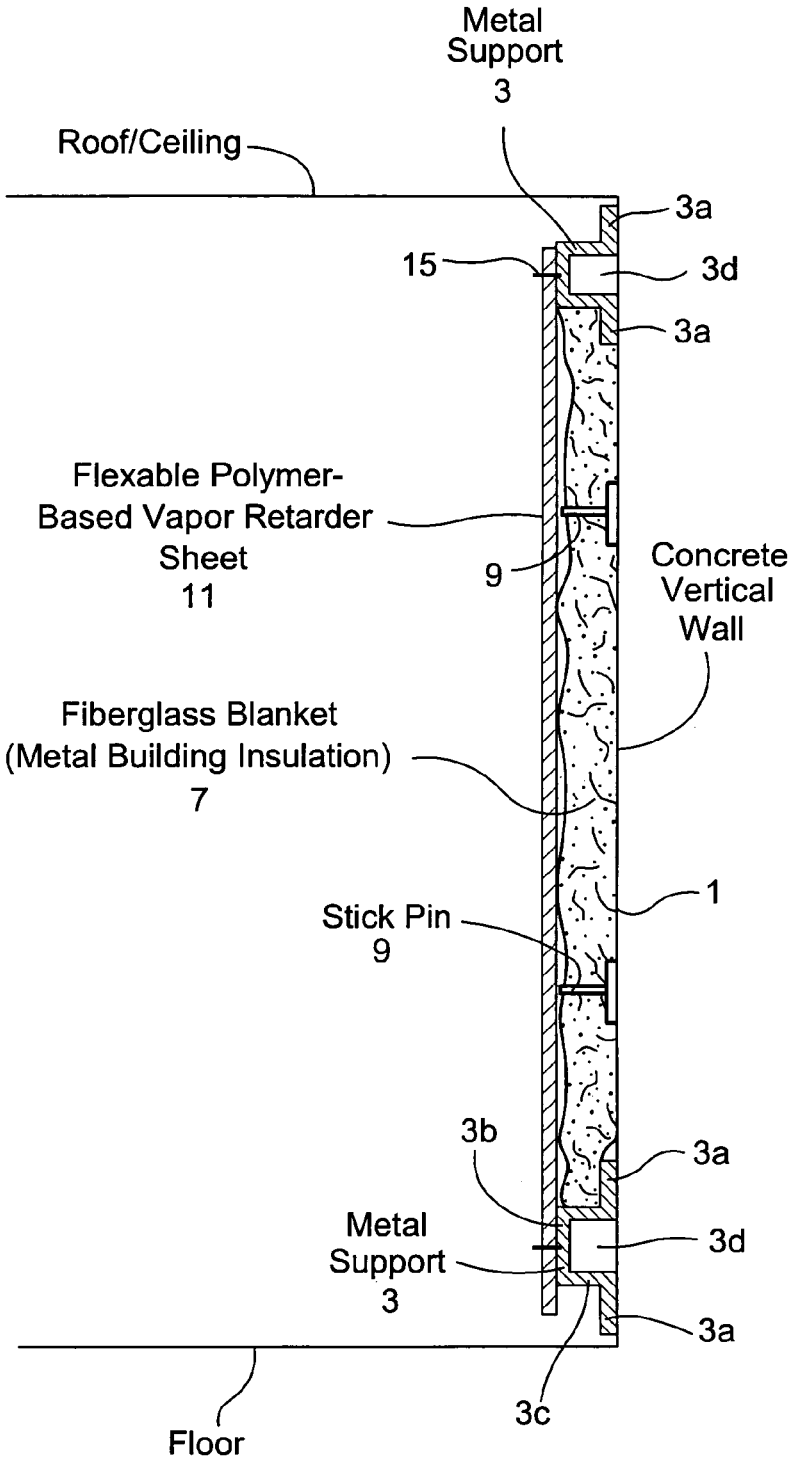
FIG. 4 is a cross sectional view of another step undertaken subsequent to the step(s) of FIGS. 1, 2 and/or 3 in insulating a vertically extending wall according to an example embodiment of this invention.
Figure 5:
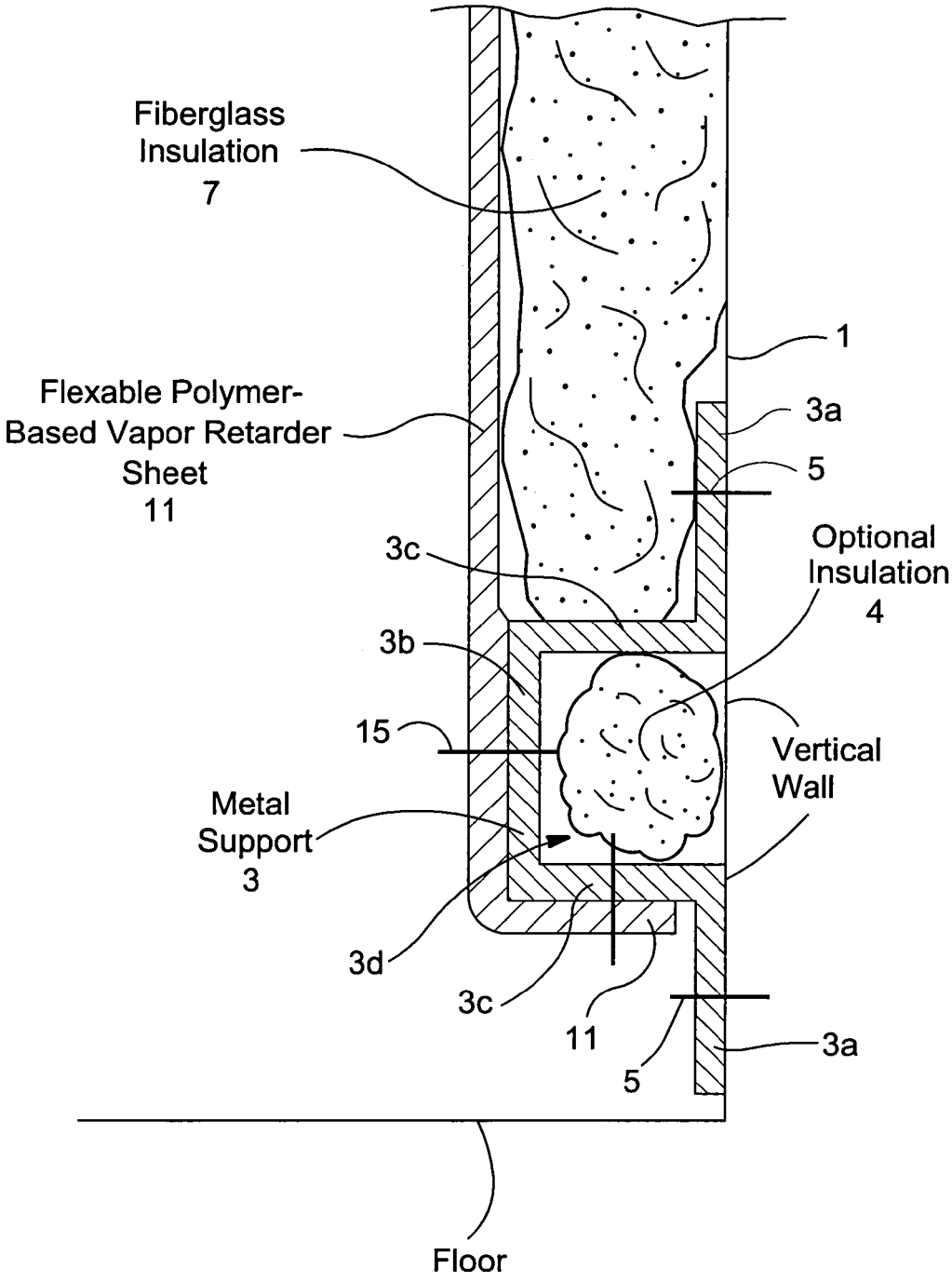
FIG. 5 is a close-up cross sectional view of the bottom support of FIG. 4, and the insulation blanket and vapor retarder proximate the same.

FIG. 4 is a cross sectional view of a concrete vertical wall insulated according to an example embodiment of this invention; and FIG. 5 is a close-up view of the bottom support of FIG. 4 and the materials proximate the same. As shown in FIGS. 4–5, the vertical wall 1 is located between the floor and roof/ceiling of the building. First and second supports 3 are attached to the vertical wall 1 at vertically spaced apart locations. The first and second supports 3 in this particular embodiment are located at the top and bottom of the wall, respectively. For purposes of example only, supports may be formed of sheet metal (e.g., 22 gauge sheet steel or any other suitable type) that is bent into the desired shape.

As shown in FIGS. 4–5, each metal support 3 includes a pair of spaced apart planar feet 3*a* (or base portions) which are adapted to be mounted flush to the wall 1. Each support 3 includes a protruding portion which extends outwardly from coplanar feet 3*a*, the protruding portion of the support including a planar attachment portion 3*b* and a pair of approximately parallel sidewalls 3*c*. In certain example embodiments, attachment portion 3*b* of the protruding portion of each support is approximately parallel (i.e., parallel +/−10 degrees) to the feet 3*a* of the corresponding support 3. A hollow channel 3*d* is defined between sidewalls 3*c* in each support 3. This channel 3*d* may optionally be insulated with fiberglass and/or foam insulation 4, or the like, as shown in FIG. 5.

Supports 3 may be attached to the vertical wall 1 in any suitable manner. For example, in certain example embodiments of this invention, nails 5 may be used to attach the supports 3 to the concrete wall 1 through the feet 3*a* of each support as best shown in FIG. 5. A suitable washer (not shown) may be pre-attached to each nail in certain example embodiments. Alternatively, screws, adhesive and/or any other type of suitable fastener may be used to attach the supports 3 to wall 1.

Still referring to FIGS. 4–5, at least one blanket of fiberglass insulation 7 is attached to the wall 1 between the first and second supports 3. The flexible blanket of fiberglass insulation may be from R10 (e.g., about 3 inches thick) to R19 (e.g., about 6 inches thick) in certain example instances. The blanket 7 of fiberglass insulation may be attached to the wall via one or more stick pins 9, nails, adhesive, and/or any other suitable type(s) of fastener. A flexible sheet of polymer-inclusive vapor retarder 11 is positioned so as to cover the insulation blanket 9. The vapor retarder sheet 11 is attached to the respective attachment portions 3*b* of the supports 3 via screws 15 or the like, so as to cover the blanket 7 of fiberglass insulation thereby causing the insulation blanket to be partially or fully hidden from view and retained in the cavity defined between the vertical wall 1 and the vapor retarder 11. No adhesive is needed between the blanket 7 and sheet 11.

Vapor retarder 11 may be of any suitable type. For example, and without limitation, the vapor retarder 11 may be a Purlin Glide (or Purlin Glide FP)™ Vapor Retarder Standard Duty (0.02 Perm), which may comprise for example a natural woven scrim substrate (e.g., HDPE 900× 1200 Denier +/−10%, (8×3)PE 1.75/1.1 inch in wrap & fill) and optionally a fire retardant low density polypropylene coating thereon. In certain example embodiments, the vapor retarder 11 may be from 1 to 15 mills thick, more preferably from 3 to 8 mills thick (ASTM D-2103). Other suitable vapor retarders may of course also be used.

Referring to FIGS. 1–6, an example process for insulating the interior surface of vertical wall 1 will now be described.

Figure 2:
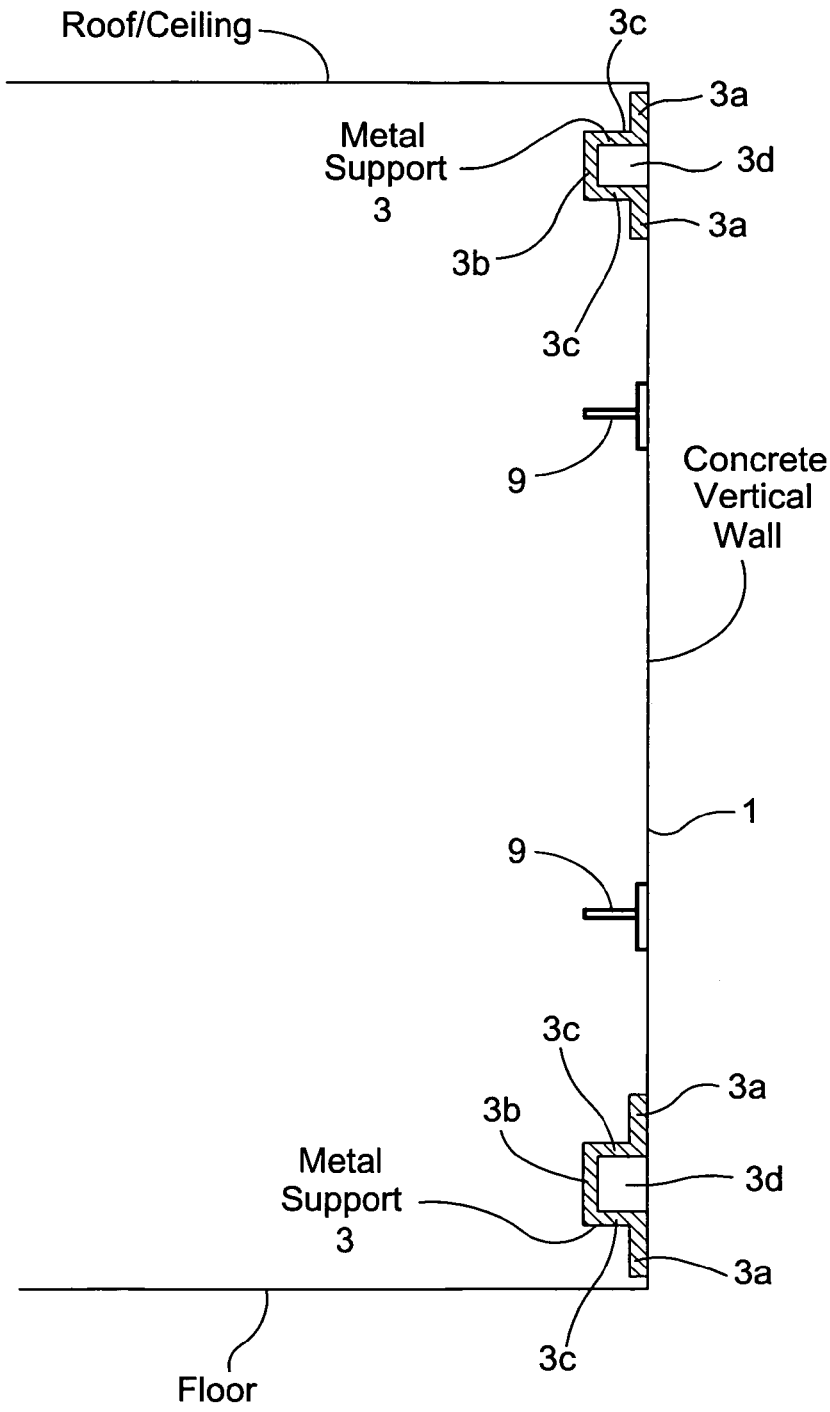
FIG. 2 is a cross sectional view of another step (optional) undertaken in insulating a vertically extending wall according to an example embodiment of this invention.

Beginning with FIG. 1, a concrete vertical wall 1 is provided between a floor and a roof/ceiling. First and second supports 3 are attached to the top and bottom of the wall 1, respectively, as can be seen in FIG. 1. Supports 3 may be attached to the wall 1 via the feet 3*a* thereof in certain example embodiments. Optionally, as shown in FIG. 2, a plurality of stick-pins 9 may be adhered to the interior surface of wall 1 between the supports 3.

Figure 3:
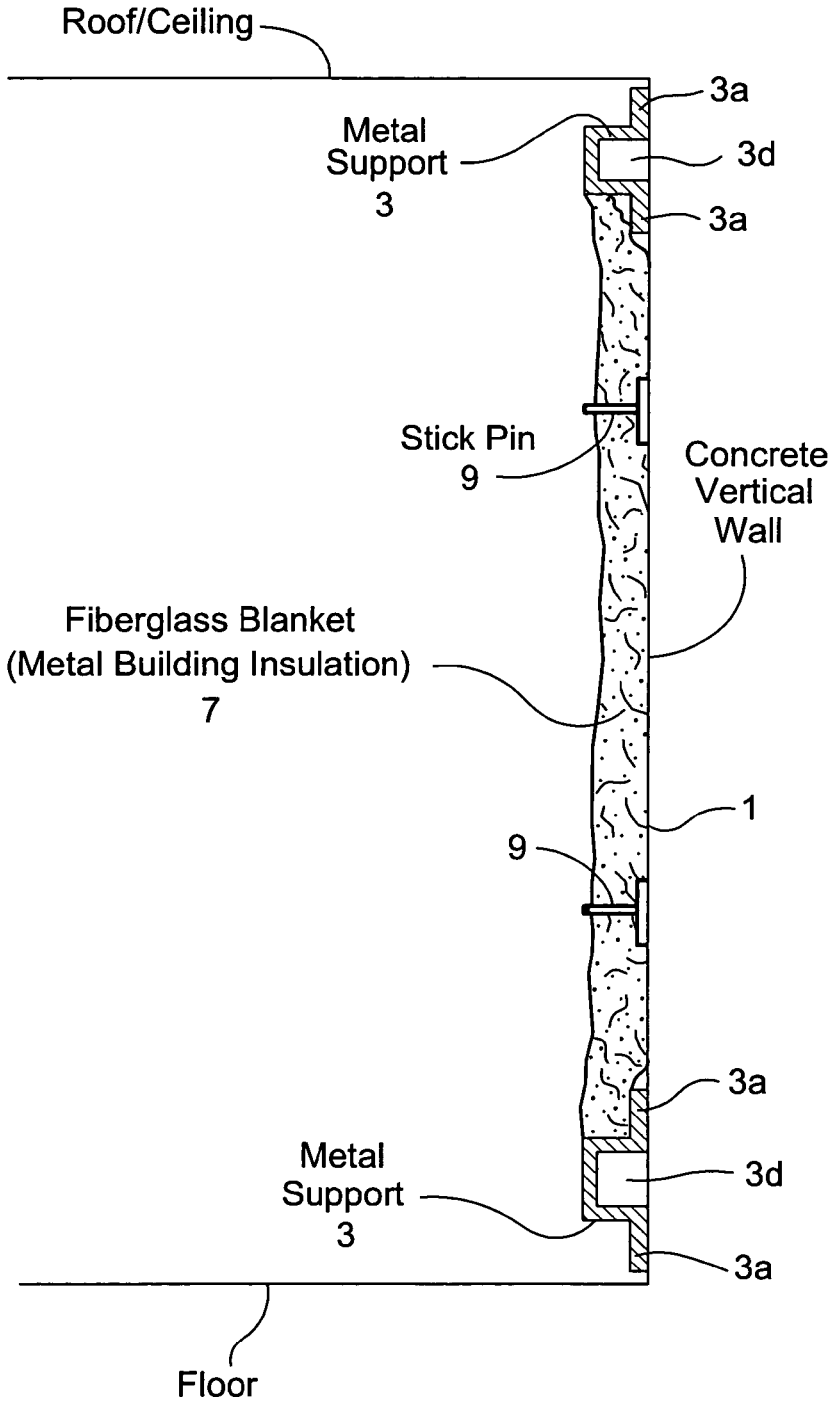
FIG. 3 is a cross sectional view of another step undertaken subsequent to the step(s) of FIGS. 1 and/or 2 in insulating a vertically extending wall according to an example embodiment of this invention.

Thereafter, a roll of fiberglass insulation is positioned at the base of the wall proximate the area to be insulated. The loose end of the insulation roll is moved to and positioned adjacent the bottom sidewall 3*c* of the top support 3. The top end of the resulting fiberglass insulation blanket 7 is positioned immediately under the bottom sidewall 3*c* of the top support 3; and the insulation is cut at an appropriate location so that the bottom end of the cut blanket 7 is positioned immediately over or above the top sidewall 3*c* of the bottom support 3 as shown in FIG. 3. The blanket 7 of fiberglass insulation may be attached to the wall via one or more stick pins 9, nails, adhesive, and/or any other suitable type(s) of fastener in different embodiments of this invention.

Then, after the insulation blanket(s) 7 has been attached to the wall 1 between the first and second supports 3, a roll of flexible vapor retarder 11 is positioned proximate the wall 1. As a sheet of the vapor retarder is unrolled, the loose end of the roll is brought to and attached to the attachment portion 3*b* of the upper support 3 via a screw 15 or the like.

Taking advantage of gravity, the vapor retarder is permitted to hang down from the top support 3 so that another portion of the vapor retarder is located proximate the bottom support 3. The vapor retarder is cut at an appropriate location and the bottom end of the resulting vapor retarder sheet 11 is attached to the attachment portion 3*b* of the bottom support 3 as shown in FIG. 4. Optionally, as shown in FIG. 5, the bottom end of the vapor retarder sheet 11 may be tucked under and attached to the bottom sidewall 3*c* of the bottom support for aesthetic reasons.

Optionally, the vapor retarder sheet 11 may also be attached to a stick pin 9 at a location spaced apart from the supports 3 so as to provide support for the sheet 11 in a central area of the wall. As another alternative, a nail gun may be used to nail the sheet 11 to the wall 1 through blanket 7 at a central area of the wall between the supports 3 for purposes of additional support for sheet 11.

The rolls of insulation and vapor retarder can then be moved over to an adjacent portion of the wall to be insulated, and the process repeated until the wall has been insulated. In certain preferred instances, the supports 3 are each of a length(s) substantially longer than the width of the blanket 7 and sheet 11 so that new supports 3 do not have to be attached for every insulation blanket that is installed.

Thus, it can be seen that there is no need to glue or otherwise adhere the insulation blanket 7 and the vapor retarder sheet 11 to one another. The insulation 7 is maintained in the cavity between the retarder sheet 11 and the wall 1 by a combination of supports 3, wall 1, stick pins 9 and/or the presence of sheet 11. No glue is necessary between the insulation and vapor retarder in certain example embodiments. This is highly advantageous in that it allows the insulation 7 and vapor retarder 11 to be transported to the installation site in roll form which can reduce transport costs and/or other burdens. Moreover, since these materials (especially the vapor retarder) are available in large widths, the number of seams in the finished product can be reduced.

While the insulation blanket 7 and vapor retarder sheet 11 may have similar widths in certain example instances, this typically is not the case. For example, in certain example embodiments, the vapor retarder sheet 11 may have a width significantly greater than that of the insulation blankets 7. In certain example embodiments, the vapor retarder sheets 11 may have a width of from 5 to 20 feet, more preferably from 11 to 13 feet, which may in some cases be wider than the blanket 7. For instances, an example blanket may be from 4–8 feet wide, more preferably about 6 feet wide. In such cases, a plurality of blankets 7 are attached to the wall 1 before a sheet 11 is located thereover as explained above. Thus, one sheet 11 may cover a plurality of insulation blankets 7 in certain example instances. For example, a 10–25 foot wide sheet 11 could cover one or more typical six foot wide fiberglass blankets 7. In certain example instances, the sheet 11 is at least twice as wide as the blanket 7.

Figure 6:
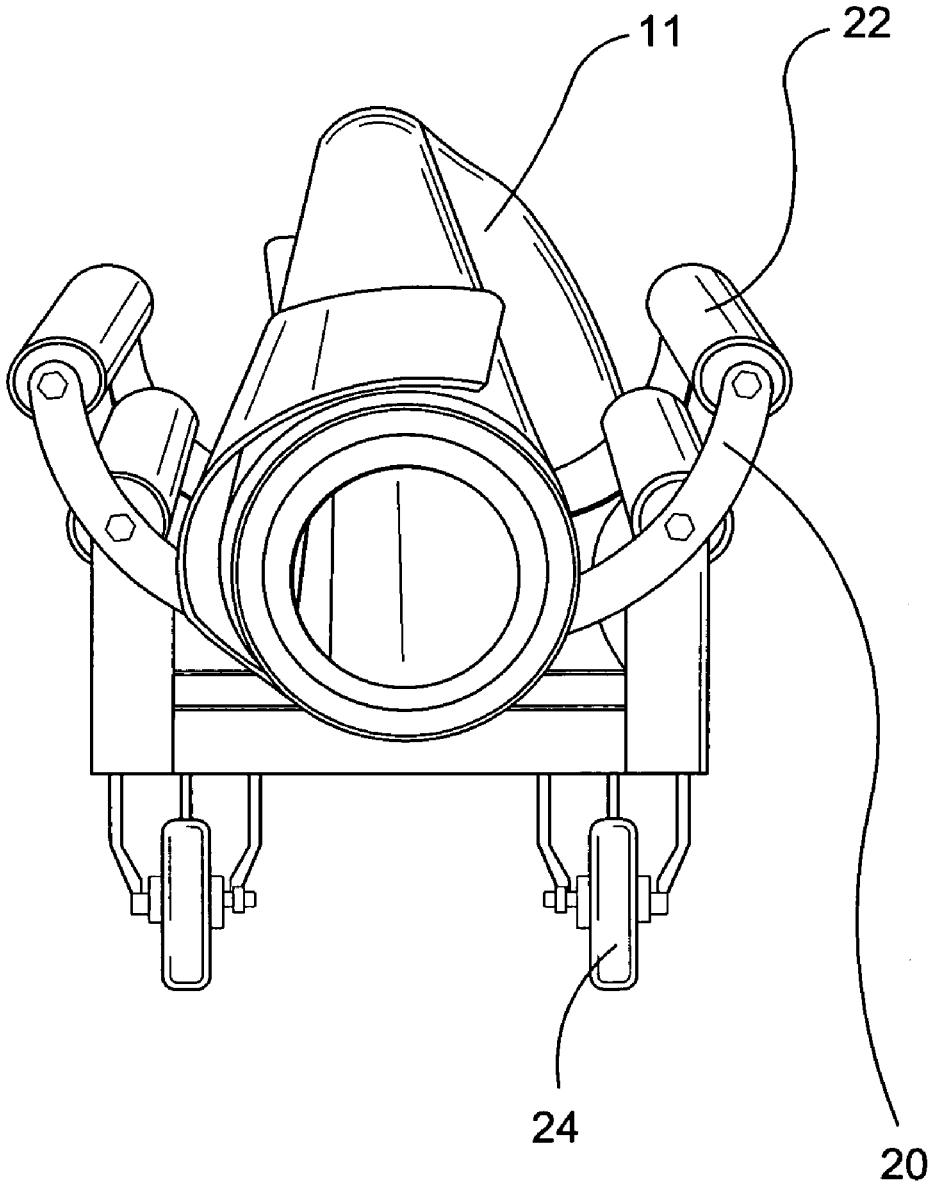
FIG. 6 is a photograph of an example payoff stand or cradle which may be used to support a roll of vapor retarder while it is being unrolled and attached to the support(s) according to an example embodiment of this invention.

FIG. 6 illustrates an example mobile cradle which may be used to support a roll of flexible vapor retarder sheet 11 in certain example embodiments of this invention. It can be seen in FIG. 6 that the cradle includes an arcuate shaped frame portion 20 which supports a plurality of rollers 22. Casters 24 permit the cradle to be rolled from one location to another to transport retarder roll(s). A roll of vapor retarder 11 is located in the central area of the cradle, and may contact one or more rollers 22. A loose end of the roll can be pulled to an appropriate location as described above, while the cradle of FIG. 6 supports the retarder roll during unrolling thereof. The use of such a cradle even further simplifies the process of vertical wall insulation described above according to certain example embodiments of this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A method of insulating a vertically extending concrete wall, the method comprising:

attaching first and second supports to the vertically extending concrete wall at respective first and second vertically spaced apart locations, each of said first and second supports including a protruding portion;

after attaching the first and second supports to the vertically extending concrete wall, attaching at least one blanket of insulation comprising fiberglass to the wall between the first and second supports;

subsequent to attaching the blanket of insulation to the wall between the first and second supports, attaching a flexible vapor retarder sheet to the protruding portion of each of the first and second supports so that the flexible vapor retarder sheet covers the blanket of insulation which is located in a cavity defined at least partially between the wall and the flexible vapor retarder sheet; and wherein said first and second supports each comprise a protruding portion which extends outwardly from coplanar feet of the support, wherein the protruding portion of each support includes a planar attachment portion connected to a pair of approximately parallel sidewalls, the sidewalls each extending between one of the feet and the attachment portion of the support.

2. The method of claim 1, wherein the flexible vapor retarder sheet covers at least first and second of said blankets of insulation which are located in the cavity defined between the wall and the flexible vapor retarder sheet.

3. The method of claim 1, wherein the flexible vapor retarder sheet is at least twice as wide as the blanket of insulation.

4. The method of claim 1, further comprising attaching the first and second supports to the vertically extending concrete wall via nails which extend through the feet of each support.

5. The method of claim 1, wherein a hollow cavity is defined between the approximately parallel sidewalls of at least one of the supports, and wherein the hollow cavity is at least partially filled with insulation.

6. The method of claim 1, wherein the blanket of insulation is attached to the wall via at least a plurality of stick pins, each stick pin including a base which is adhered to the wall and an extension member which protrudes from the base and into the blanket of insulation for supporting the blanket of insulation.

7. The method of claim 1, wherein there is no glue which adheres the flexible vapor retarder sheet to the blanket of insulation.

8. The method of claim 1, wherein the first support is attached to a top portion of the wall and the second support is attached to a bottom portion of the wall.

9. The method of claim 1, wherein the flexible vapor retarder sheet comprises a woven substrate that supports a polymer based coating.

10. The method of claim 9, wherein the polymer based coating comprises polypropylene.

11. The method of claim 9, wherein the flexible vapor retarder sheet is from 1 to 15 mills thick.

12. The method of claim 9, wherein the flexible vapor retarder sheet is attached to the supports so as to be approximately parallel to the wall.

13. The method of claim 1, wherein the flexible vapor retarder sheet is attached to the protruding portion of each of the first and second supports via respective screws which extend through the flexible vapor retarder sheet and also through the respective protruding portions of the supports.

14. A method of insulating a vertically extending wall, the method comprising:

attaching first and second supports to the vertically extending wall at respective first and second vertically spaced apart locations, each of said first and second supports including a protruding portion and at least one base portion, the at least one base portion of each support being flush with the wall;

after attaching the first and second supports to the vertically extending wall, locating a blanket of insulation adjacent the wall between the first and second supports;

subsequent to said locating of the blanket of insulation between the first and second supports, attaching a flexible sheet to the protruding portion of each of the first and second supports so that the flexible sheet covers at least part of the blanket of insulation which is located in a cavity defined at least partially between the wall and the flexible sheet; and wherein said first and second supports each comprise a protruding portion which extends outwardly from feet of the base portion of the support, wherein the protruding portion of each support includes a planar attachment portion connected to a pair of approximately parallel sidewalls, the sidewalls each extending between one of the feet and the attachment portion of the support.

15. A vertically insulated wall structure comprising:

a vertically extending concrete wall;

first and second supports attached to the vertically extending concrete wall at respective first and second vertically spaced apart locations, each of said first and second supports including a protruding portion;

a blanket of insulation comprising fiberglass attached to the wall between the first and second supports;

a flexible vapor retarder sheet attached to the protruding portion of each of the first and second supports so that the flexible vapor retarder sheet covers the blanket of insulation which is located in a cavity defined at least partially between the wall and the flexible vapor retarder sheet; and wherein at least one of said supports comprises a protruding portion which extends outwardly from coplanar feet of the support, wherein the protruding portion includes a planar attachment portion connected to a pair of approximately parallel sidewalls, the sidewalls each extending between one of the feet and the attachment portion of the support.

16. The structure of claim 15, wherein the flexible vapor retarder sheet covers at least first and second of said blankets of insulation which are located in the cavity defined between the wall and the flexible vapor retarder sheet.

17. The structure of claim 15, wherein the flexible vapor retarder sheet is at least twice as wide as the blanket of insulation.

18. The structure of claim 15, wherein the flexible vapor retarder sheet comprises a woven substrate that supports a polymer based coating.

* * * * *